United States Patent [19]

Herbert

[11] Patent Number: 4,733,866

[45] Date of Patent: Mar. 29, 1988

[54] PORTABLE STRING ALIGNER FOR RACKETS

[76] Inventor: Jacob F. Herbert, 635 Circlewood Dr., Paradise, Calif. 95969

[21] Appl. No.: 928,190

[22] Filed: Nov. 7, 1986

[51] Int. Cl.[4] ..... A63B 49/00

[52] U.S. Cl. ..... 273/73 R; 242/157 R

[58] Field of Search ..... 273/73 R, 73 A, 73 B, 273/73 D, 73 C, 282 R, 281, 282 C; 29/241; 242/157 R; 28/212, 213, 115, 152; 38/102, 94; 264/174, 291

[56] References Cited

U.S. PATENT DOCUMENTS 4,089,523 5/1978 Newburger et al. ..... 273/73 R 4,489,942 12/1984 Kent ..... 273/73 R

*Primary Examiner*—Matthew L. Schneider

[57] ABSTRACT

A portable string aligner for tennis rackets, racquetball rackets, and for other game equipment in which a racket is used. The aligner combines an elongated rectangular base member with multiple spacing pegs removably fitted in a retainer track. The spacing-peg tops protruding externally through a track opening in one surface of the base member are of sufficient length and are shaped to fit through the squares formed by the vertical and horizontal cross-over of the racket strings in a strung racket head. By hand pressuring the spacing pegs through the racket string squares, the racket strings can be restored to proper alignment on the court during pauses in play.

7 Claims, 8 Drawing Figures

PORTABLE STRING ALIGNER FOR RACKETS

BACKGROUND OF THE INVENTION

1. Field of the Invention

This invention relates to hand-held devices useful for respacing the racket strings of tennis rackets, racquetball rackets, and the like in the field. The present invention is particularly directed towards a portable tool to be used during breaks in play on the courts to realign the vertical and horizontal positioning of racket strings which have moved during game use. The classes and subclasses in general proximity to the present invention include 273/73A, 73B, 73D, 73R U.S. and Foreign Art. The present invention is a simplified and further development of the art.

2. Description of the Prior Art

What were considered the most pertinent prior art patents included the following: A. Johnson, U.S. Pat. No. 2,156,092, issued Apr. 25, 1939, which shows a hand-held device useful to position strings while restringing a racquet. The Dec. 30, 1941, U.S. Pat. No. 2,268,276, granted to M. Caro et al also illustrating a device for restringing a racquet. Another stringing device is seen in British Patent No. 1,118,777, dated July 3, 1968, and U.S. Pat. No. 3,994,496, of Nov. 10, 1976, is a hand-held transverse stringer.

An interesting publication of prior art is a 1977 mail order catalogue page from "Stahls" of Roseville, Mich., shows a device as a "clamp holds strings in alignment," and a tennis racket string positioning device is disclosed in U.S. Pat. No. 4,082,272, dated Apr. 1, 1978, issued to J. P. Graver. Two foreign patents, DE No. 3135-521 (1983) and DE No. 3337-341-A (1984), show string aligner devices.

No past art examined seems adequately designed with adjustment capabilities to encompas vertical and horizontal racket string tuning on the string frames of both tennis and racquetball rackets.

SUMMARY OF THE INVENTION

To overcome the deficiencies seen in the offered devices, I provide a hand-held racket string tuner with provisions for vertical and horizontal repositioning of the strings after use.

Therefore, it is a primary object of my invention to provide a portable string tuner for rackets useful on the court.

Another object of my invention is to provide a portable racket string tuner with adjustable spacing pegs.

A further object of the invention is to provide a portable racket string tuner which can be used on tennis or racquetball rackets.

A still further object of this invention is to provide a racket string tuner with replaceable pegs which can be supplied in various desired shapes.

Many other objects and advantages of this invention will be understood with a reading of the numbered parts in the specification in conjunction with like numbered parts shown on the drawings.

DESCRIPTION OF THE PREFERRED EMBODIMENT

Figure 1:
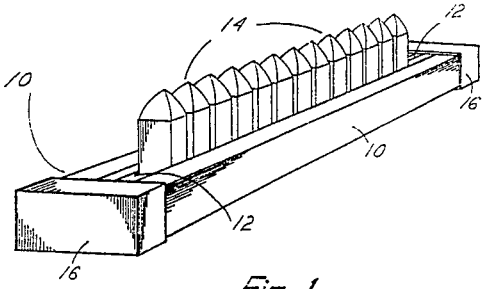
FIG. 1 is a perspective drawing of the portable string tuner for rackets constituting the present invention.
Figure 2:
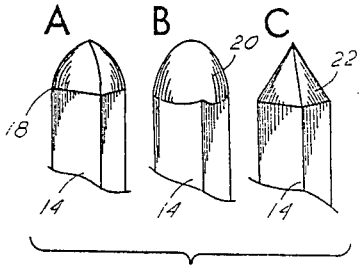
FIG. 2 illustrates spacing peg shapes with beveled at A, bullet at B, and pyramid at C.
Figure 3:
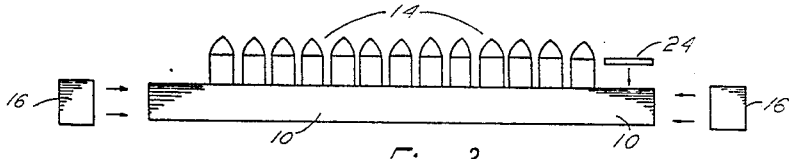
FIG. 3 is a side view of the racket string tuner assemblage with track filler and end caps position for attachment.
Figure 4:
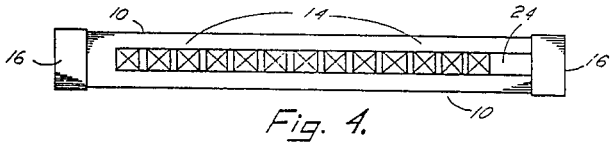
FIG. 4 shows FIG. 3 in a plan top view with track filler installed and end caps attached.

Referring now to the drawings wherein FIG. 1 shows a perspective view of the string tuner assemblage with base member 10 supporting spacing pegs 14 in retainer track 12. End caps 16 are removeably attached to base member 10 as retainers for spacing pegs 14. The spacing pegs 14 can have varied shapes as needed to part and position the racket strings. FIG. 2 illustrates shapes with A showing spacing peg 14 having beveled top 18, B showing spacing peg 14 with bullet-shaped top 20, and C showing spacing peg 14 with pyramid top. In the assemblage side view at FIG. 3, base member 10 is fitted with spacing pegs 14 which will be retained in retainer track 12 (not seen) by end caps 16. A track filler 24 is positioned in retainer track 12 as needed to prevent end movement of spacing pegs 14. The relationship of the various parts can be seen in the plan veiw of FIG. 4 Base member 10 holds the spacing pegs 14 aligned by track filler 24 and retained by caps 16.

Figure 5:
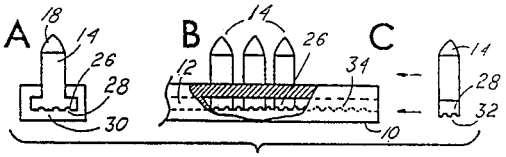
FIG. 5 illustrates spacing peg structure and peg retainers in the retainer track with A showing an end view, B showing a side view, and C showing a side view of an individual spacing peg.
Figure 6:
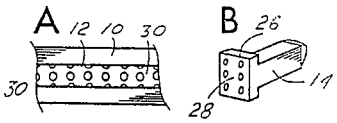
FIG. 6 at A shows a top sectional view of the base member track illustrating knobbed track flooring and at B shows the matching dimpled bottom of the spacing peg foot.

In FIG. 5, the confined positioning of the spacing pegs 14 and the mechanics therefor are illustrated. At A in FIG. 5, spacing peg 14 with beveled top 18 has spacing peg foot 26 affixed with a dimpled foot bottom 28 which fits the knobbed track bottom 30 in a retained position in track 12. Spacing peg 14 is shown in an end view to illustrate the T-type spacing peg foot 26. At B in FIG. 5, the spacing pegs 14 are shown in a side view with base member 10 opened to illustrate retainer track 12 having a corrugated track floor 34 which fits the corrugated foot bottom 32 of the spacing pegs 14 in the embodiment illustrated. At C, a side view of a spacing peg 14 is shown with spacing peg foot 26 having a corrugated foot bottom 32. In FIG. 6 at A a section of base member 10 is shown in a top view illustrating retainer track 12 with a knobed track floor 30. At B in FIG. 6, spacing peg 14 is angled to show the spacing peg foot 26 from the under side and illustrate a dimpled foot bottom 28. The corrugation fittings and the knob and dimple fittings are used to retain the spacing pegs 14 positioned in retainer track 12.

Figure 7:
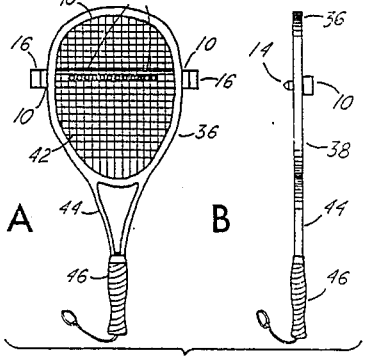
FIG. 7 illustrates the portable string tuner in use on a tennis racket in a frontal view at A and in a side view at B.
Figure 8:
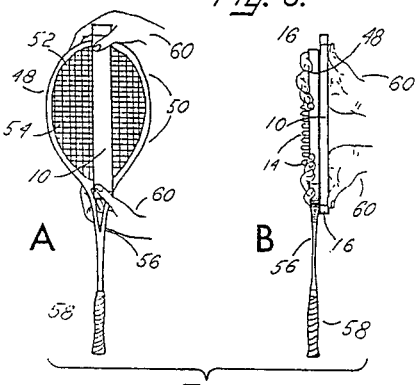
FIG. 8 show the racket string tuner used vertically on a racquetball string frame in a frontal view at A and in a side view at B.

In FIG. 7 at A the string tuner is shown in use on a tennis racket 36. base member 10 is pressed against the tennis racket strings with spacing pegs 14 passing between vertical strings 40 and horizontal strings 42. End caps 16 can be seen extended past the ends of of tennis racket string frame 38. The positioning of the tuner in the "sweet spot" on the tennis racket strings can be seen above tennis racket throat 44 and handle 46. The tuner is pulled back and reinserted horizontally and vertically as needed to realign the tennis racket strings after use. At FIG. 8, a racquetball racket 48 is illustrated. Spacing pegs 14 are adjusted for size required by removal of caps 16 and the vertical strings 52 and horizontal strings 54 can be repositioned as needed by player 60. FIG. 8 at A is a frontal view of racquetball racket 48 being vertically aligned and in a side view at B. The numbers shown include racquetball racket string frame 50, racquetball racket throat 56, and racquetball racket handle 58.

Although I have described my invention in the specification with considerable details, it is to be understood that certain modifications in the structure and design of the invention may be practiced which do not depart from the scoop of the appended claims.

What I claim is:

1. A portable string aligner comprising: an elongated rectangular base member having a T-shaped retainer groove located therein, said retainer groove having a bottom surface; a plurality of spacing pegs removably fitted within said retainer groove, said spacing pegs comprising T-shaped members having lower portions that correspond to the shape of the retainer groove, said spacing pegs extending above the surface of the base member so that they can be inserted between the crossing strings of a racket and thereby align the strings, said spacing pegs having a bottom surface that contacts the bottom surface of the retainer groove and the bottom surface of both the retainer groove and the spacing pegs having positioning means located thereon for selectively positioning the spacing pegs in the retaining groove; said aligner further comprising an end cap fitted over each end of the base member so as to prevent the spacing pegs from sliding out of the retaining groove and a track filler positionable between the spacing peg and one of the end caps for preventing movement of the spacing pegs.

2. The portable string aligner as set forth in claim 1, wherein the portion of said spacing pegs that extends above the surface of the base member is configured in a pyramidal, bullet or bevelled shape.

3. The portable string aligner as set forth in claim 1, wherein said positioning means comprises dimples on the bottom of said spacing pegs and knobs on the bottom of said retaining groove.

4. The portable string aligner as set forth in claim 1, wherein said positioning means comprises interfitting corrugations on the bottom of the spacing pegs and the bottom of the retaining groove.

5. The portable string aligner as set forth in claim 1 wherein the protruding spacing pegs are sized for use with the strung heads of tennis rackets.

6. The portable string aligner as set forth in claim 1 wherein the protruding spacing pegs are sized for use with the strung heads of racquetball rackets.

7. The portable string aligner as set forth in claim 1 wherein the protruding spacing pegs are variously sized for multi-purpose use with the strung heads of squash and badminton rackets.

* * * * *